US010188157B2

(12) United States Patent
Tschantret et al.

(10) Patent No.: US 10,188,157 B2
(45) Date of Patent: Jan. 29, 2019

(54) INSULATED ATHLETIC SUPPORT GARMENT

(71) Applicants: Ulysse Tschantret, Towson, MD (US); Erin Tschantret, Towson, MD (US)

(72) Inventors: Ulysse Tschantret, Towson, MD (US); Erin Tschantret, Towson, MD (US)

( * ) Notice: Subject to any disclaimer, the term of this patent is extended or adjusted under 35 U.S.C. 154(b) by 19 days.

(21) Appl. No.: 15/254,308

(22) Filed: Sep. 1, 2016

(65) Prior Publication Data

US 2018/0055101 A1 Mar. 1, 2018

(51) Int. Cl.

| | |
|---|---|
| ***A41D 13/005*** | (2006.01) |
| ***A41D 13/00*** | (2006.01) |
| ***A41B 9/02*** | (2006.01) |
| *A41D 7/00* | (2006.01) |
| *A41D 31/00* | (2006.01) |
| *A41B 9/00* | (2006.01) |

(52) U.S. Cl.

CPC ..... *A41D 13/0015* (2013.01); *A41B 9/02* (2013.01); *A41B 9/002* (2013.01); *A41D 31/0038* (2013.01)

(58) Field of Classification Search

CPC .. A41D 1/08; A41D 13/0015; A41D 2600/10; A41D 2400/38; A41D 27/00; A41D 31/02; A41D 13/015; A41D 13/0575; A41D 13/0525; A41D 2300/22; A41D 2500/50; A41D 7/00; A41D 7/005; A63B 71/1216

See application file for complete search history.

(56) References Cited

U.S. PATENT DOCUMENTS

| | | | | |
|---|---|---|---|---|
| 4,875,236 | A * | 10/1989 | Boynton | A41D 7/00 2/67 |
| 4,956,878 | A * | 9/1990 | Boynton | A41D 7/00 2/67 |
| 5,243,974 | A * | 9/1993 | Allen | A41B 9/02 128/891 |
| 5,758,519 | A * | 6/1998 | Joyce | D04B 21/20 2/220 |
| 6,052,824 | A * | 4/2000 | May | A41D 13/08 2/16 |
| 6,171,606 | B1 * | 1/2001 | Lyons | A61F 15/004 424/402 |
| 7,135,007 | B2 * | 11/2006 | Scott | A61F 13/085 602/75 |
| 9,932,151 | B2 * | 4/2018 | Sagan | B65D 33/28 |
| 2003/0019476 | A1 * | 1/2003 | Chambers | A41D 13/005 123/438 |

(Continued)

OTHER PUBLICATIONS

"Ice Water Immersion improves performance", https://breakingmuscle.com/fitness/ice-water-immersion-improves-performance ; accessed Nov. 13, 2017; footnotes cite references dated 2012.*

*Primary Examiner* — Bobby Muromoto, Jr.
(74) *Attorney, Agent, or Firm* — Heslin Rothenberg Farley & Mesiti P.C.; Nathan B. Davis

(57) ABSTRACT

Athletic garments and methods of their use are provided. One garment includes, for instance: a waist band, and an insulated panel configured to form a pouch to conformally cover a groin and genital area of a person. At least one end of the insulated panel is coupled to a portion of the waistband. Also disclosed is a method of using the athletic garment including providing the athletic garment and providing an ice bath for a person wearing the athletic garment.

20 Claims, 3 Drawing Sheets

(56) References Cited

U.S. PATENT DOCUMENTS

| | | | | |
|---|---|---|---|---|
| 2008/0125842 | A1* | 5/2008 | Petitt | A41D 13/0012 607/108 |
| 2010/0129573 | A1* | 5/2010 | Kim | A41D 31/005 428/34.1 |
| 2010/0205722 | A1* | 8/2010 | Kim | A41D 31/005 2/455 |
| 2011/0196458 | A1* | 8/2011 | Bratcher, Jr. | A61F 7/02 607/108 |
| 2012/0078147 | A1* | 3/2012 | Ogulnick | A41D 13/0058 602/2 |
| 2014/0073496 | A1* | 3/2014 | Bannerman | A63B 21/0442 482/139 |
| 2015/0059390 | A1* | 3/2015 | Hayes | A61F 7/02 62/259.3 |
| 2015/0089707 | A1* | 4/2015 | Walmsley | A41D 13/0058 2/69 |
| 2017/0021975 | A1* | 1/2017 | Sagan | B65D 33/28 |
| 2017/0183469 | A1* | 6/2017 | Falken | C08J 9/009 |
| 2018/0222638 | A1* | 8/2018 | Sagan | B65D 33/28 |

* cited by examiner

INSULATED ATHLETIC SUPPORT GARMENT

FIELD OF THE INVENTION

The present invention relates to support garments, and more particularly, to insulated athletic support garments for use in an ice bath.

BACKGROUND OF THE INVENTION

In athletic or work-related activities, pain, inflammation, and trauma can often result in the need of an ice bath or other cooling of the whole body or large portions of the body. However, the groin and genital region of the body is often more sensitive to extreme temperatures than the rest of the body.

Therefore, it may be desirable to protect the groin and genital region during an ice bath.

BRIEF SUMMARY

The shortcomings of the prior art are overcome and additional advantage are provided through the provisions, in one aspect, an athletic garment that includes, for instance: a waist band; and an insulated panel configured to form a pouch to conformally cover a groin and genital area of a person, at least one end of the insulated panel being coupled to a portion of the waistband.

In another aspect, method is provided which includes, for instance: providing an athletic garment, the athletic garment including: a waist band; and an insulated panel configured to form a pouch to conformally cover a groin and genital area of a person, at least one end of the insulated panel being coupled to a portion of the waistband, and providing an ice bath for the person, wherein the athletic garment protects the groin of the person from the ice bath when submersed therein.

The insulated panel of the athletic garment can be rubber, synthetic rubber, polymer, or synthetic polymer. The insulated panel can be neoprene, for instance foam neoprene. The insulated panel can be between approximately 1 mm thick and approximately 5 mm thick. The waistband of the athletic garment can include an elastic material. The waistband can be adjustable. The athletic garment can further include a set of straps coupled to the waistband on one end and the insulated panel on another end, the set of straps being configured to assist in securing the insulated panel conformally to the person. The set of straps can be elastic. The athletic garment can include a set of adjusters within a set of opposite sides of the insulated panel for adjusting a fit of the insulated panel to the person. The adjusters can include a flexible cord and a set of slidably adjustable connectors.

BRIEF DESCRIPTION OF THE SEVERAL VIEWS OF THE DRAWINGS

One or more aspects of the present invention are particularly pointed out and distinctly claimed as examples in the claims at the conclusion of the specification. The foregoing and other objects, features, and advantages of the invention are apparent from the following detailed description taken in conjunction with the accompanying drawings in which:

DETAILED DESCRIPTION

Aspects of the present invention and certain features, advantages, and details thereof, are explained more fully below with reference to the non-limiting embodiments illustrated in the accompanying drawings. Descriptions of well-known materials, fabrication techniques, etc., are omitted so as to not unnecessarily obscure the invention in detail. It should be understood, however, that the detailed description and the specific examples, while indicating embodiments of the invention, are given by way of illustration only, and are not by way of limitation. Various substitutions, modifications, additions and/or arrangements within the spirit and/or scope of the underlying inventive concepts will be apparent to those skilled in the art from this disclosure. Note also that reference is made below to the drawings, which are not drawn to scale for ease of understanding, wherein the same reference numbers used throughout different figures designate the same or similar components.

Generally stated, disclosed herein are athletic garments. Advantageously, the athletic garment protects the groin and genital region from exposure to extreme temperatures.

Figure 1A:
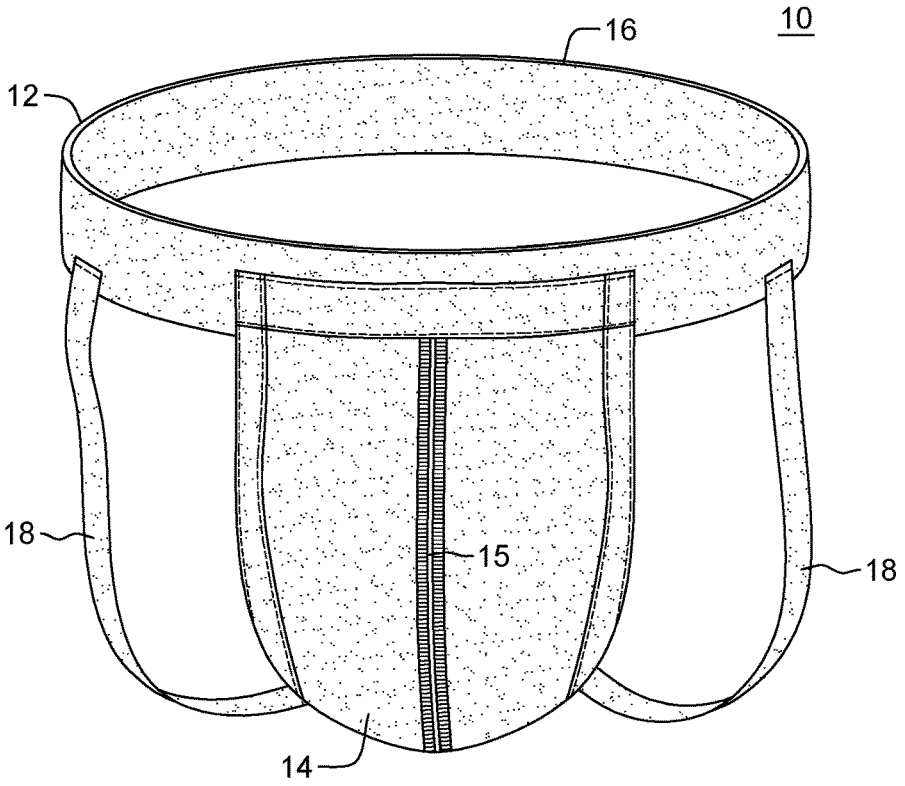
FIG. 1A depicts one embodiment of a front elevational view of an athletic garment, in accordance with one or more aspects of the present invention.

In one aspect, in one embodiment, as shown in FIG. 1A, an embodiment of an athletic garment 10 is shown. The athletic garment 10 can take the form of an athletic support garment. Thus, the athletic garment 10 can include a waist band 12. In some embodiments, the waist band 12 may be an elastic waist band, which can include any now known or later developed stretch fabric of synthetic or natural materials, including but not limited to spandex, neoprene, Lycra, and elastane. In some embodiments, for a versatile size waist band, the waist band 12 may include a plurality of pieces of fabric having a fastener, for instance, a fibrous hook and loop material for securing the waist band 12 at any size necessary for a preferred fit.

An insulated panel 14 may be coupled to at least a portion of the waist band 12 on at least one end. This can include any coupling means necessary, such as sewing or gluing, but may also include a releasable coupling such as hook and loop materials to secure the insulated panel 14. The insulated panel 14 is configured to form a pouch to conformally cover the groin and/or genital area of a person. For instance, the insulated panel 14 may be formed of two pieces of material with a seam 15 down the middle to allow for shaping of a pouch to protect and secure groin and genital area of a male or a female, and thus can include a variety of sizes and curvatures of the insulated panel 14. The insulated panel 14 may cover only the front, or may extend to a back side 16 of waist band 12 (not shown) and be secured thereon.

The insulated panel 14, in order to protect from extreme temperatures, can include a single layer of insulative material, an insulating liner within another material, or multiple layers of one or both of these materials. In some embodiments, the insulated panel 14 can include an insulating material of one or more of a rubber, a synthetic rubber, a polymer, or a synthetic polymer. For instance, in some embodiments, the insulated panel 14 may be made from polychloroprene, or neoprene. Neoprene may be used in various forms, but in some embodiments, the insulated panel 14 may be made from foam neoprene. The neoprene of insulated panel 14, whether used alone or with another material, may be between approximately 1 millimeter (mm) thick and 5 mm thick.

Figure 1B:
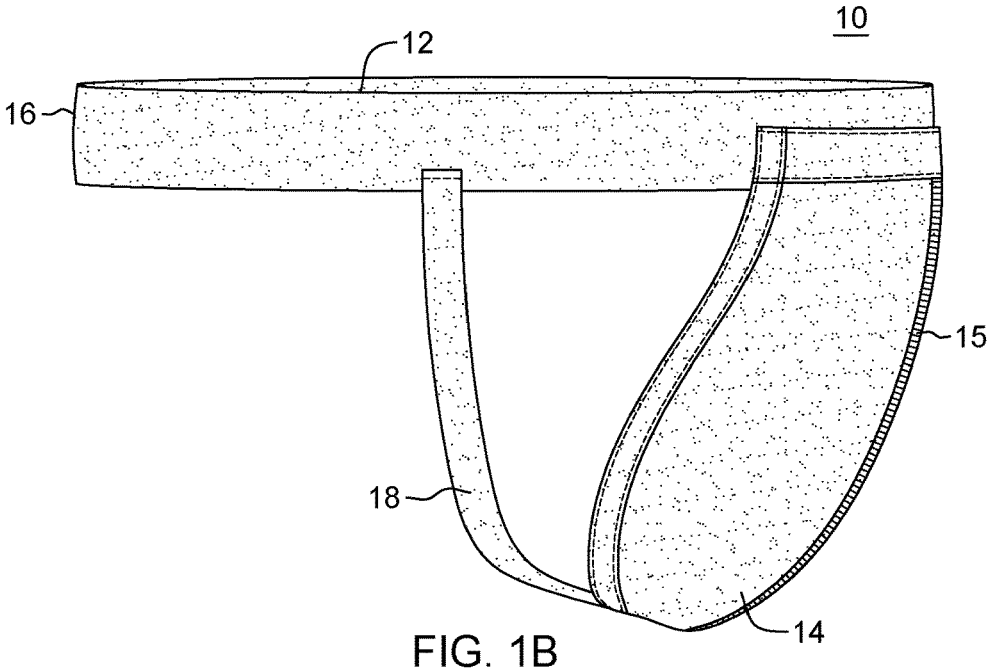
FIG. 1B a side view of the athletic garment of FIG. 1A, in accordance with one or more aspects of the present invention.

In some embodiments, the athletic garment 10 may include a set of straps 18 coupled to the waist band 12 on one end and the insulated panel 14 on the other end, as illustrated in FIG. 1B. The set of straps 18 can thus be configured to assist in securing the insulated panel 14 conformally to the person, by holding a back side of the insulated panel 14 more closely in place. The set of straps 18 may be elastic. In some embodiments, the set of straps 18 may be releasably coupled to the waist band 12 in order to allow for adjustments to the fit of athletic garment 10.

Figure 2A:
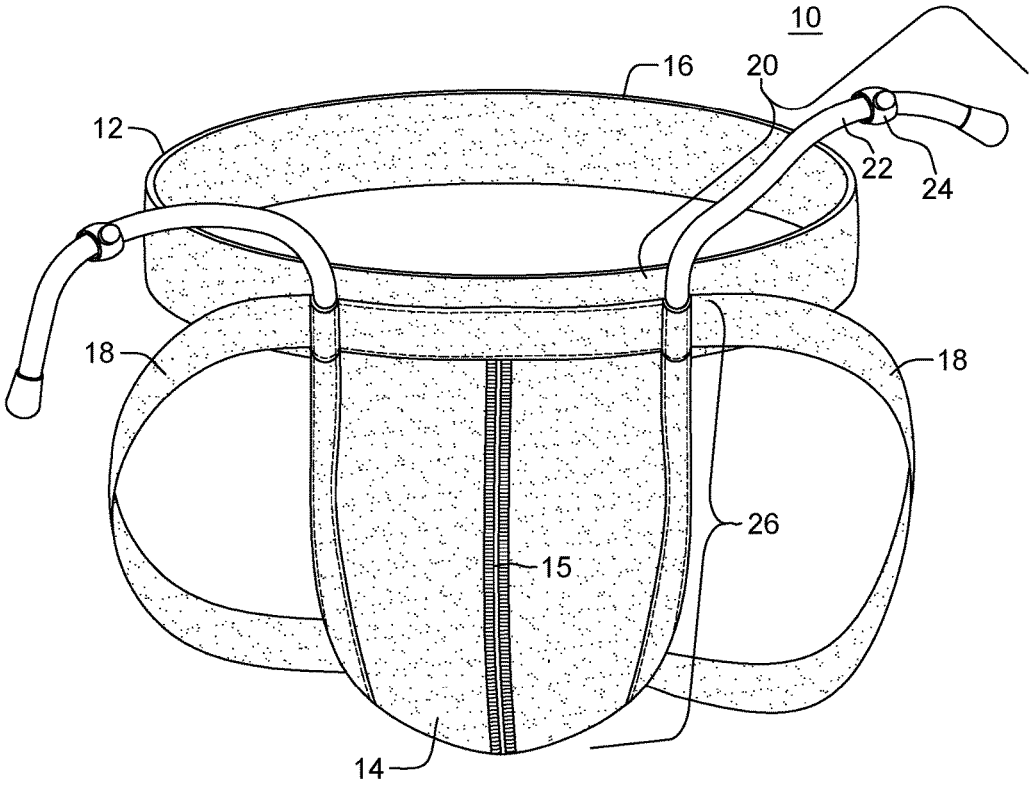
FIG. 2A depicts one embodiment of a front elevational view of an athletic garment, in accordance with one or more aspects of the present invention.
Figure 2B:
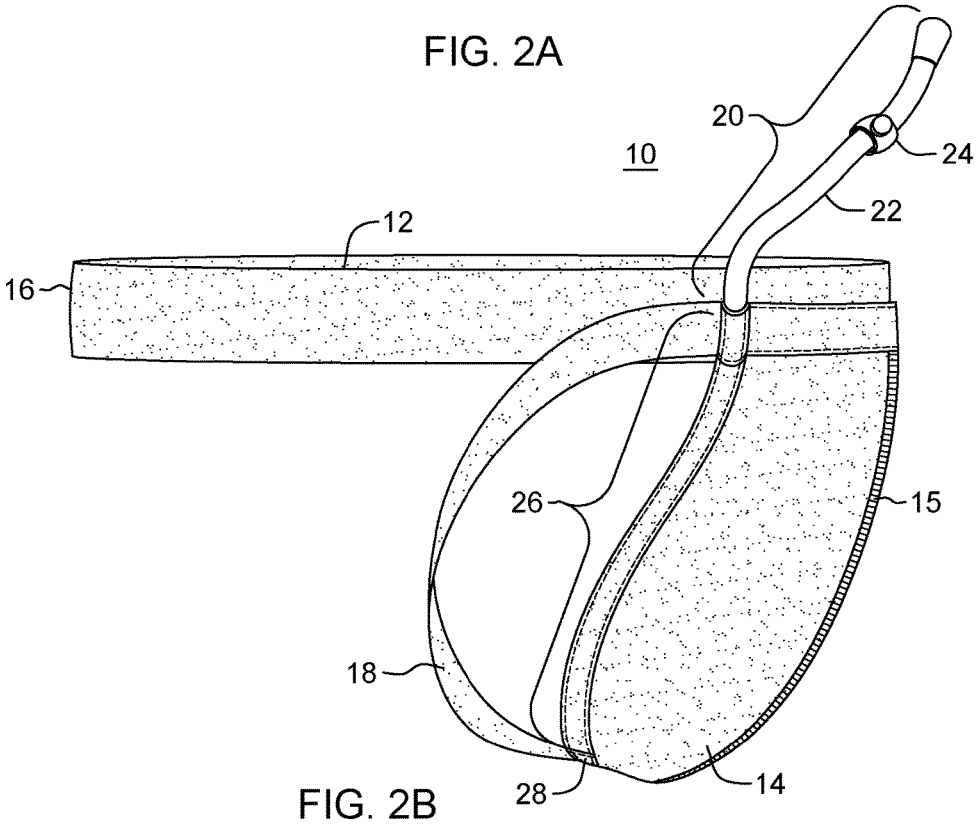
FIG. 2B a side view of the athletic garment of FIG. 2A, in accordance with one or more aspects of the present invention.

In another embodiment, as shown in FIG. 2A, the athletic garment 10 may include, either in combination with the set of straps 18 or alone, a set of adjusters 20 for adjusting the fit of the insulated panel 14 to a person. For instance, the set of adjusters 20 may include an elastic or a flexible cord 22 and a set of slidably adjustable connectors 24. In some embodiments, to allow for a very close fit of the insulated panel 14 to a person's groin and genital area, the cord 22 can be sewn into a pouch or channel 26 included along sides of insulated panel 14. The channels 26 can run along the two sides of insulated panel 14 and secured to a back side 28 of insulated panel 14, as depicted in FIG. 2B. In some embodiments, the channels 26 may run along a full channel across the back of insulated panel 14, thus forming a single, continuous channel 26 and utilizing a single cord 22 rather than two or more cords.

The set of slidably adjustable connectors 24 may include any connector capable of having cord 22 run therethrough and being adjusted to remain in a particular portion of cord 22. For instance, connectors 24 can include cord fasteners or cord toggles including but not limited to barrel-type cord locks, plastic cord locks, metal cord locks, no spring cord locks, cord locks with springs, and rim cord locks. The connectors 24 can be used to tighten the cord 22 under the legs and along the groin and genital area of a person, making for a secure fit and protection from extreme temperatures.

Figure 3:
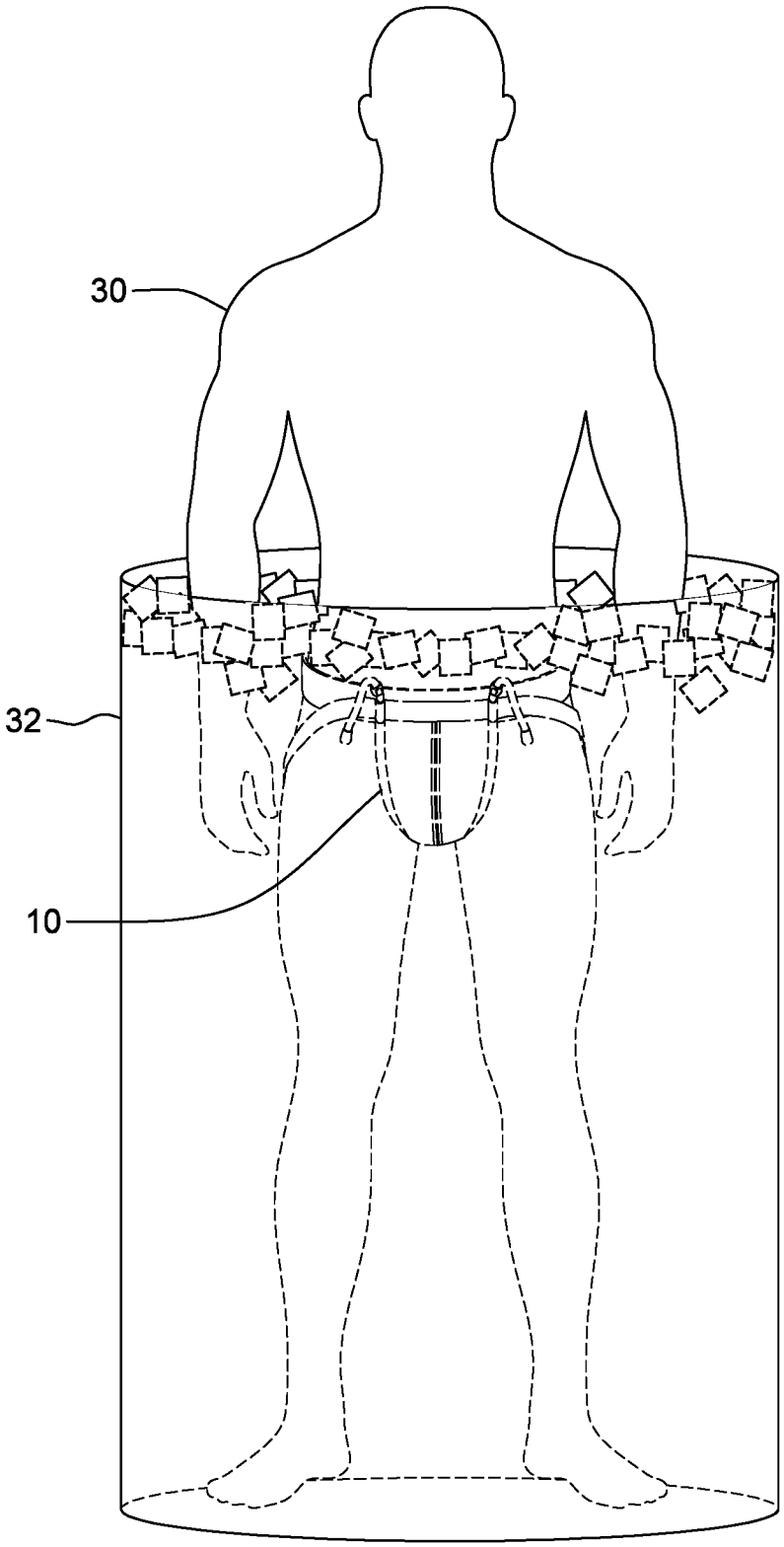
FIG. 3 depicts one embodiment of a method of using an athletic garment in an ice bath, in accordance with one or more aspects of the present invention.

As depicted in FIG. 3, further embodiments include a method of using an athletic garment 10. For instance, a method can include providing an athletic garment 10, as disclosed above, to a person 30. The person 30 may be a male or female of any age. The insulated panel 14 (FIG. 2A) of the athletic garment 10 protects the person's groin and/or genital area when, for instance, an ice bath 32 is provided for the person 30. For instance, traumatic pain or inflammation can result from athletic or work related activities, in one or more small or large areas of the person's body. The ice bath 32 can reduce the pain and/or the inflammation. In some instances, it may be difficult to provide ice to a particular area, or too many areas or too large of an area may require icing. Methods according to certain embodiments allow for nearly full body exposure to an ice bath, or even heat in some instances, whilst protecting the groin and the genital area from exposure to these temperatures. For example, injuries such as hip flexor strains, hernias, strains or sprains to any of the lower extremities, shin splints, and stress fractures may require the lower half of the body, including, in some instances, the abdomen or lower back, to be submersed in cold water or ice water for an extended period of time, such as up to twenty minutes. The invention allows for the body of person 30 and parts thereof to be exposed to an ice bath 32 whilst insulating the bather's groin and/or genital areas.

Thus, using embodiments described above, an athletic garment is provided which can protect a person's sensitive areas from exposure to extreme temperatures but allowing near full body exposure otherwise.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprise" (and any form of comprise, such as "comprises" and "comprising"), "have" (and any form of have, such as "has" and "having"), "include" (and any form of include, such as "includes" and "including"), and "contain" (and any form contain, such as "contains" and "containing") are open-ended linking verbs. As a result, a method or device that "comprises", "has", "includes" or "contains" one or more steps or elements possesses those one or more steps or elements, but is not limited to possessing only those one or more steps or elements. Likewise, a step of a method or an element of a device that "comprises", "has", "includes" or "contains" one or more features possesses those one or more features, but is not limited to possessing only those one or more features. Furthermore, a device or structure that is configured in a certain way is configured in at least that way, but may also be configured in ways that are not listed.

The corresponding structures, materials, acts, and equivalents of all means or step plus function elements in the claims below, if any, are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of one or more aspects of the invention and the practical application, and to enable others of ordinary skill in the art to understand one or more aspects of the invention for various embodiments with various modifications as are suited to the particular use contemplated.

What is claimed is:

1. An athletic garment, comprising:

a waist band;

an insulated panel to conformally cover a groin and genital area of a person, at least one end of the insulated panel being coupled to a portion of the waistband;

a cord contained within a channel surrounding all but a top side of the insulated panel; and a pair of slidably adjustable connectors on either side of the cord for tightening the insulated panel conformally against the groin and genital area of the person, wherein the insulated panel is configured to insulate and protect the groin and genital area of the person against an ice bath when the person is submersed therein.

2. The athletic garment of claim 1, wherein the insulated panel comprises at least one of a group including: rubber, synthetic rubber, polymer, and synthetic polymer.

3. The athletic garment of claim 2, wherein the insulated panel comprises neoprene.

4. The athletic garment of claim 3, wherein the neoprene comprises foam neoprene.

5. The athletic garment of claim 4, wherein the insulated panel is between approximately 1 mm thick and approximately 5 mm thick.

6. The athletic garment of claim 1, wherein the waistband comprises an elastic material.

7. The athletic garment of claim 1, wherein the waistband is adjustable.

8. The athletic garment of claim 1, further comprising:

a set of straps coupled to the waistband on one end and the insulated panel on another end, the set of straps being configured to assist in securing the insulated panel conformally to the person.

9. The athletic garment of claim 8, wherein the set of straps are elastic.

10. The athletic garment of claim 1, wherein the cord comprises a flexible cord.

11. A method of using an athletic garment, comprising:

providing an athletic garment, the athletic garment comprising:

a waist band;

an insulated panel to conformally cover a groin and genital area of a person, at least one end of the insulated panel being coupled to a portion of the waistband;

a cord contained within a channel surrounding all but a top side of the insulated panel; and a pair of slidably adjustable connectors on either side of the cord for tightening the insulated panel conformally against the groin and genital area of the person; and providing an ice barb for the person, wherein the insulated panel of the athletic garment insulates and protects the groin and genital area of the person from the ice bath when submersed therein.

12. The method of claim 11, wherein the insulated panel comprises at least one of a group including: rubber, synthetic rubber, polymer, and synthetic polymer.

13. The method of claim 12, wherein the insulated panel comprises neoprene.

14. The method of claim 13, wherein the neoprene comprises foam neoprene.

15. The method of claim 14, wherein the insulated panel is between approximately 1 mm thick and approximately 5 mm thick.

16. The method of claim 11, wherein the waistband comprises an elastic material.

17. The method of claim 11, wherein the waistband is adjustable.

18. The method of claim 11, the athletic garment further comprising:

a set of straps coupled to the waistband on one end and the insulated panel on another end, the set of straps being configured to assist in securing the insulated panel conformally to the person.

19. The method of claim 18, wherein the set of straps are elastic.

20. The method of claim 11, wherein the cord comprises a flexible cord.

* * * * *